US006804834B1

(12) United States Patent
Mok

(10) Patent No.: US 6,804,834 B1
(45) Date of Patent: Oct. 19, 2004

(54) SUSPENDER SET

(76) Inventor: Peter Mok, 44845 Fremont Blvd., Fremont, CA (US) 94538

( * ) Notice: Subject to any disclaimer, the term of this patent is extended or adjusted under 35 U.S.C. 154(b) by 45 days.

(21) Appl. No.: 10/378,193

(22) Filed: Mar. 3, 2003

(51) Int. Cl.[7] ..... A41F 3/00
(52) U.S. Cl. ..... 2/329
(58) Field of Search ..... 2/326, 327, 329, 2/328, 336, 310, 338, 340, 79, 227, 314, 315, 323, 300; 24/698.1, 698.2, 697.2

(56) References Cited

U.S. PATENT DOCUMENTS 1,280,184 A * 10/1918 Dow ..... 2/323
1,342,704 A * 6/1920 Young ..... 2/310
2,308,278 A * 1/1943 Gluckmann ..... 2/117
2,315,698 A * 4/1943 Gluckmann ..... 2/117
2,824,022 A * 2/1958 Sucetti ..... 427/213
3,167,786 A * 2/1965 Johnson ..... 2/327
5,353,479 A 10/1994 Lucier
5,488,738 A 2/1996 Seamans
5,623,735 A 4/1997 Perry
6,006,365 A 12/1999 Stranberg
6,088,831 A 7/2000 Jensen
6,088,839 A 7/2000 Utamaru

* cited by examiner

*Primary Examiner*—Tejash Patel
(74) *Attorney, Agent, or Firm*—Howard E. Lebowitz

(57) ABSTRACT

This invention pertains to a suspender set intended to be worn with a belt and worn under a person's shirt where it can not be seen that the person is wearing suspenders. The suspender set is particularly useful for a uniformed officer who carries heavy equipment on a belt, but can not wear suspenders because of uniform requirements. The invention is also useful for people who would like to wear shirt and suspenders without the societal stigma associated with wearing both belt and suspenders.

22 Claims, 4 Drawing Sheets

SUSPENDER SET

BACKGROUND OF THE INVENTION

1. Field of the Invention

This invention pertains to a suspender set for supporting a belt that is worn on a person's lower body clothing, such as trousers. More particularly the invention pertains to a suspender which can be worn under a wearer's shirt.

2. Description of the Prior Art

The prior art for suspenders is primarily the familiar devices that comprise elastic bands which pass over a persons shoulders and support the person's trousers or skirt by attaching thereto with buttons or clamps. Suspenders are generally considered a replacement for a belt, though some people are known to "wear both belt and suspenders". In this case, where belt and suspenders are worn together, they are employed independently, so that both the belt and suspenders do their function of holding up clothing just as they would if used alone. In all cases, over the shoulder suspenders are worn in plane view, outside of a shit.

U.S. Pat. No. 5,353,479 to Lucier discloses a clip carrier for concealing a jaw type suspender clip for use with ordinary suspenders.

U.S. Pat. No. 5,488,738 to Seamans discloses a system for supporting a belt worn on a lower body garment by using multiple straps removably and adjustably attached by means of loop-hook fasteners to the inside lining of an upper body garment (such as a jacket or vest).

U.S. Pat. No. 5,623,735 to Perry discloses elastic strap suspenders which have a connector at the end of each strap in the shape of a hook for hooking onto the bottom of belt worn on trousers.

U.S. Pat. No. 6,006,365 to Strandberg discloses a method of supporting trousers on a person using a plurality of connectors at spaced locations at the front and rear of the trousers and a belt extending over the person's shoulders and back and around the circumference of the trousers.

U.S. Pat. No. 6,088,831 to Jensen discloses a Peace Officers Uniform With Gear Support which is an integrated uniform including body armor which is worn under the officer's shirt wherein a service belt worn outside of the officer's pants, from which heavy equipment is hung, is supported in place by belts and fastening means worn on the body armor, on the inside of the shirt and inside of the pants.

U.S. Pat. No. 6,088,839 to Utamaru discloses a suspenders which have hooks at the end of the suspender straps which engage with belt loops on trousers.

U.S. Pat. Nos. 5,353,479, 5,488,738, 5,623,735, 6,006,365, 6,088,831, and 6,088,839 are incorporated by reference herein in their entirety.

The prior art has generally recognized the need for a means of supporting a heavy belt by means such as a suspenders, and various suspenders are known to support a belt worn on trousers or other lower body garments.

However, there is often a need for a suspender set that can be used to support a belt and will also be usable in a situation where a user does not want the suspenders to be seen outside of the clothes. One example is a peace officer. A peace officer often carries substantial heavy equipment from the belt worn through loops on the trousers. The weight of the equipment makes the belt sag and impairs the officer's movement. In principal, an officer could wear over the shoulder suspenders to hold up the belt. However, an officer is generally not allowed to wear suspenders because of uniform regulations.

Another example is a person who desires to wear belt and suspenders both but does not want to assume the negative characterization in society that goes along with someone who "wears both belt and suspenders.

There is a need for an over the shoulder suspender set which can be worn with a belt and support the belt while the suspender straps are under the shirt.

There is a need for a method of supporting a belt with over the shoulder suspenders while hiding the suspenders below a wearer's shirt.

SUMMARY OF THE INVENTION

It is an object of the invention to provide a suspender set that is capable of supporting a belt from an over the shoulder elastic strap while the strap is concealed under a user's shirt.

It is a further object of the invention to provide a method for supporting a belt with elastic suspenders worn over the shoulders of a user while the suspenders are concealed under the user's shirt.

The invention solves the problem of wearing suspenders to support a belt that is worn on a lower body garment such as trousers, shorts, or a skirt, in a situation where it is desired to conceal the suspenders from view. One situation where the problem occurs is a uniformed peace officers who wear belts from which heavy equipment is suspended. It would be helpful to use suspenders to hold up the peace officer's belt, however peace officers are generally restricted from varying the standard uniform to include suspenders. The suspenders of the instant invention are capable of being worn under an officer's shirt and out of sight. Another situation involves people who want to wear both belt and suspenders, without the societal stigma of wearing both belt and suspenders together.

One aspect of the invention is a suspender set comprising an elastic strap with two hangers attached to the elastic strap, with each hanger having a broad hook. The suspender set furtherer comprises two "W" shaped holders. Each of the "W" shaped holders has three parts a first part, a second part and a third part. The second part is flexibly attached to the first part and the third part is flexibly attached to the second part.

The first part comprises a ledge with size and shape to be engaged by one of the two broad hooks and the third part has a belt hook. The second part is attached to the first part at a first end of the second part and the third part is attached to the second part near a second end of the second part such that the second part can be flexed to create a first space between the first part and the second part and the third part is attached to the second part such that the third part can be flexed to create a second space between the third part and the second part.

Another aspect of the invention is use of a suspender set to hold up a belt worn on a lower body garment, such as trousers, shorts or a skirt. The suspender set is used to support a belt by the following three steps:

1. Placing the elastic band over a persons shoulders,
2. placing each of the two "W" shaped holders on two opposite sides of the person such that the first part and second part of each "W" shaped holder are between the lower body garment and the person and the third part passes over the lower body garment and under the belt such that the belt is supported by the belt hook, and
3. placing the broad hook on each of the two hangers through the ledge on one of the two "W" shaped holders, such that the belt is supported by the elastic strap.

An upper body garment, such as a shirt, may be placed over the suspenders and tucked into the first space, the space between the first part and the second part. When so worn the suspenders are hidden under the upper body garment except for the third part of the "W" shaped holders which is behind the belt except for the belt hook.

A preferred embodiment the elastic strap comprises an elastic band that is doubled over with the ends of the band bonded together, so that when the strap is stretched out it has two sides. A doubled over type elastic strap is preferably deployed by completing the three step process above with the elastic strap doubled over to form a top portion and a bottom portion, and then placing a first arm between the top portion and the bottom portion in a first direction so as to push the top portion behind the person's back, and then placing a second arm between the top portion and the bottom portion in a second direction so as to push the bottom portion behind the person's back. Thus deployed the top portion and bottom portion will cross behind the person's back and allow for conformable wear and good distribution of the load.

A still further aspect of the invention is a kit comprising an elastic strap, a plurality of hangers for use on the elastic strap, and a plurality of "W" shaped holders.

A still further aspect of the invention are "W" shaped holders, alone, which can be used with ordinary suspenders.

BRIEF DESCRIPTION OF THE DRAWINGS

These and other features, aspects and advantages of the present invention will become better understood with regard to the following description, appended claims and accompanying drawings, where:

DESCRIPTION

Figure 1:
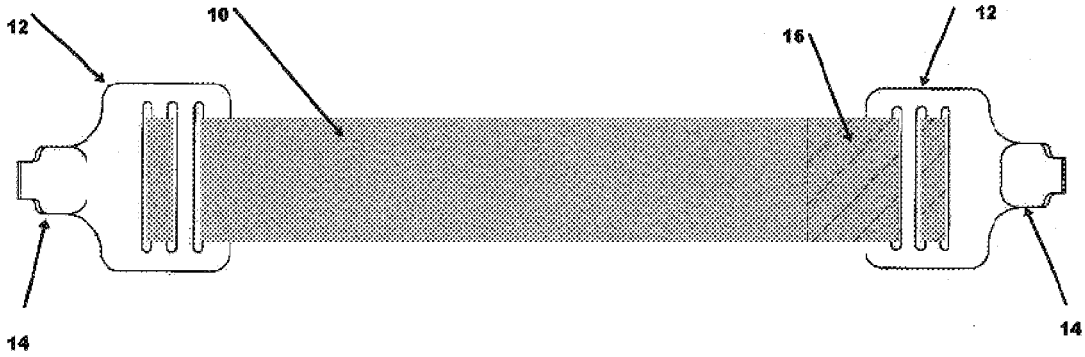
FIG. 1 is a top view of an elastic band and hangers

One aspect of the invention is a suspender set comprising an elastic strap with two hangers attached to the elastic strap, with each hanger having a broad hook. An elastic strap may be a strap out of any material such as rubber or flexible polymers which returns to its original shape after being stretched. Preferably, the strap is a flexible stretchable fabric made with interwoven strands of rubber or a synthetic fiber, most preferably the type comprising interwoven rubber strands. The elastic strap is preferably a broad strap in order to be capable of supporting a large amount of weight and to distribute the weight over a large area. The elastic strap is preferably deployed doubled over with the two ends bonded together to form a loop. The ends may be bonded together by such conventional means as thermal bonding, adhesive, or stitching. A strap width of about ¾ inch to 3 inches is preferred, more preferably 1 ½ to 3 inches, most preferably about 2 inches. The type of hanger is preferably of the adjustable type that is well known to those skilled in the art and that has slots to fasten the strap through and allows the effective length of the strap to be varied by taking up more or less of the strap between the slots. The hangars end in a flat hook. FIG. 1 illustrates a doubled elastic strap 10 and two adjustable hangers 12 attached thereto each hanger ending in a broad hook 14. The strap has two portions which are superimposed on FIG. 1, and bonded together in the hatched section 16.

The suspender set further comprises two "W" shaped holders. Each of the "W" shaped holders has three parts a first part, a second part and a third part. The second part is flexibly attached to the first part and the third part is flexibly attached to the second part. The first part comprises a ledge with size and shape to be engaged by one of the two broad hooks and the third part has a belt hook. The second part is attached to the first part at a first end of the second part and the third part is attached to the second part near a second end of the second part such that the second part can be flexed to create a first space between the first part and the second part and the third part is attached to the second part such that the third part can be flexed to create a second space between the third part and the second part.

Figure 2A:
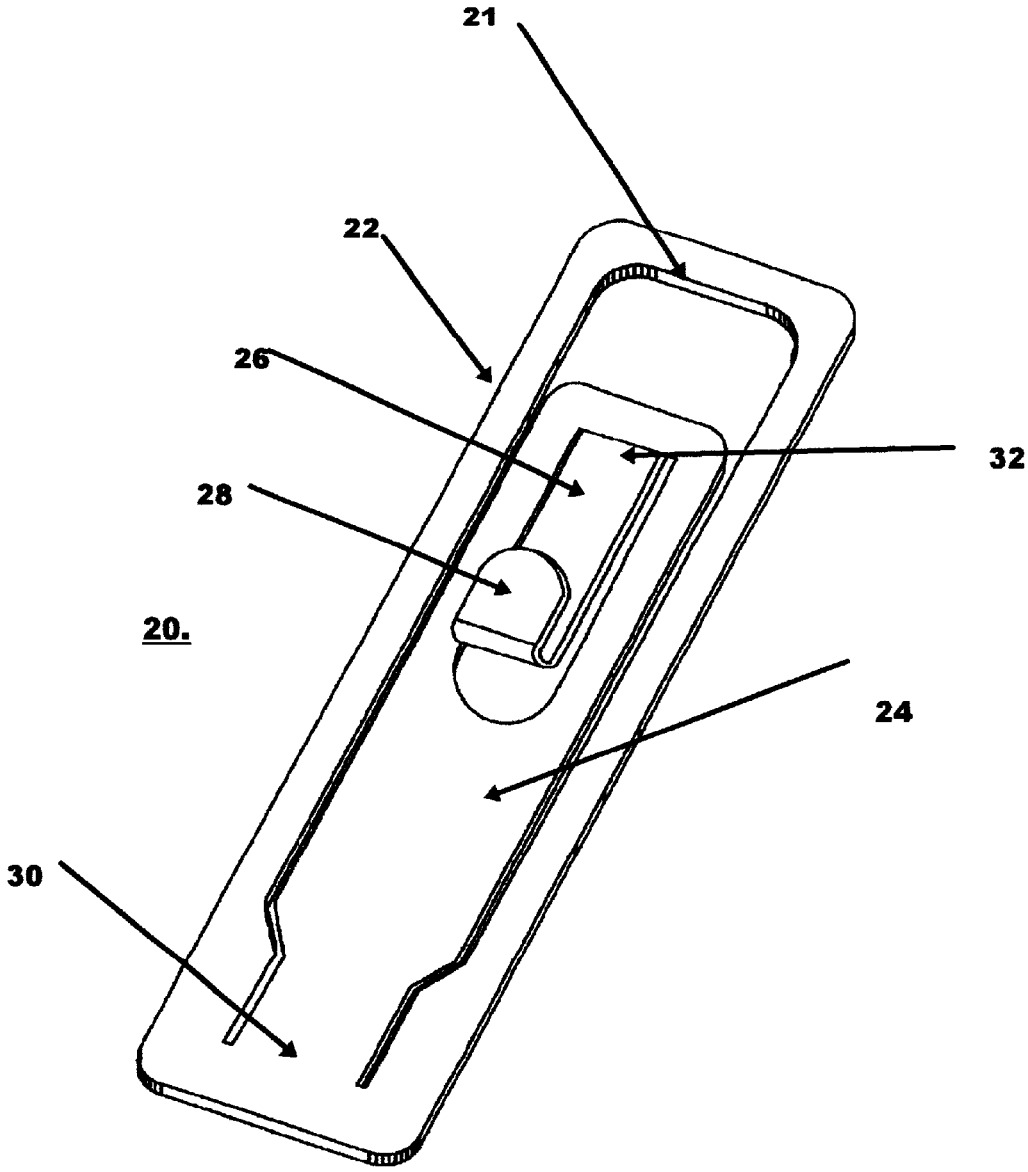
FIG. 2A is a perspective view of a "W" shaped holder.
Figure 2B:
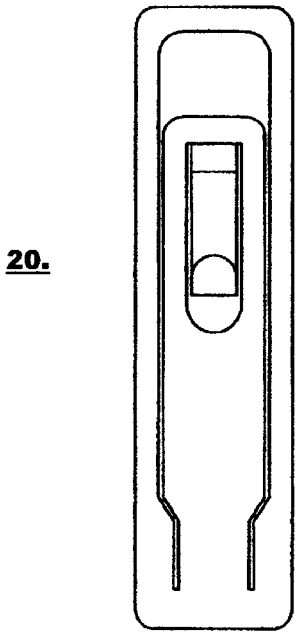
FIG. 2B is a top view of a "W" shaped holder.
Figure 2C:
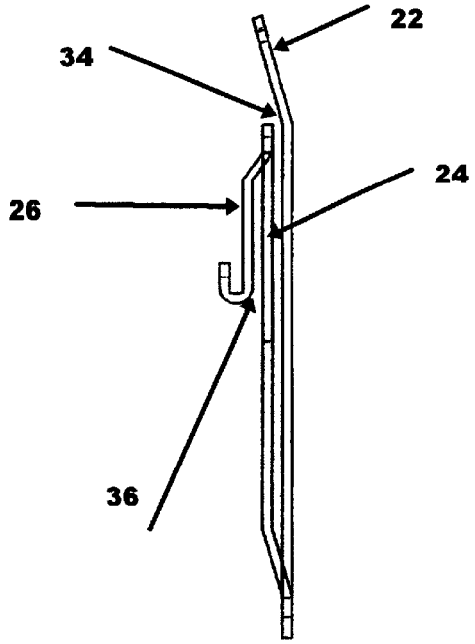
FIG. 2C is a side view "W" shaped holder in a flexed configuration.

FIG. 2A shows a perspective view of a "W" shaped holder 20, with a first part 22 having a ledge 21, a second part 24, and a third part 26. At the end of the third part is belt hook 28. The second part is flexibly joined to the first part at joint 30, and the third part is joined to the second part at joint 32 at the opposite side of the second part from joint 30. In FIG. 2A the second part and third part are collapsed inside the first part. FIG. 2B is a top vies of the "W" shaped grip. FIG. 2C is a side view that shows second part 24 and third part 26 are flexed to create a first space 34 and a second space 36.

Figure 3:
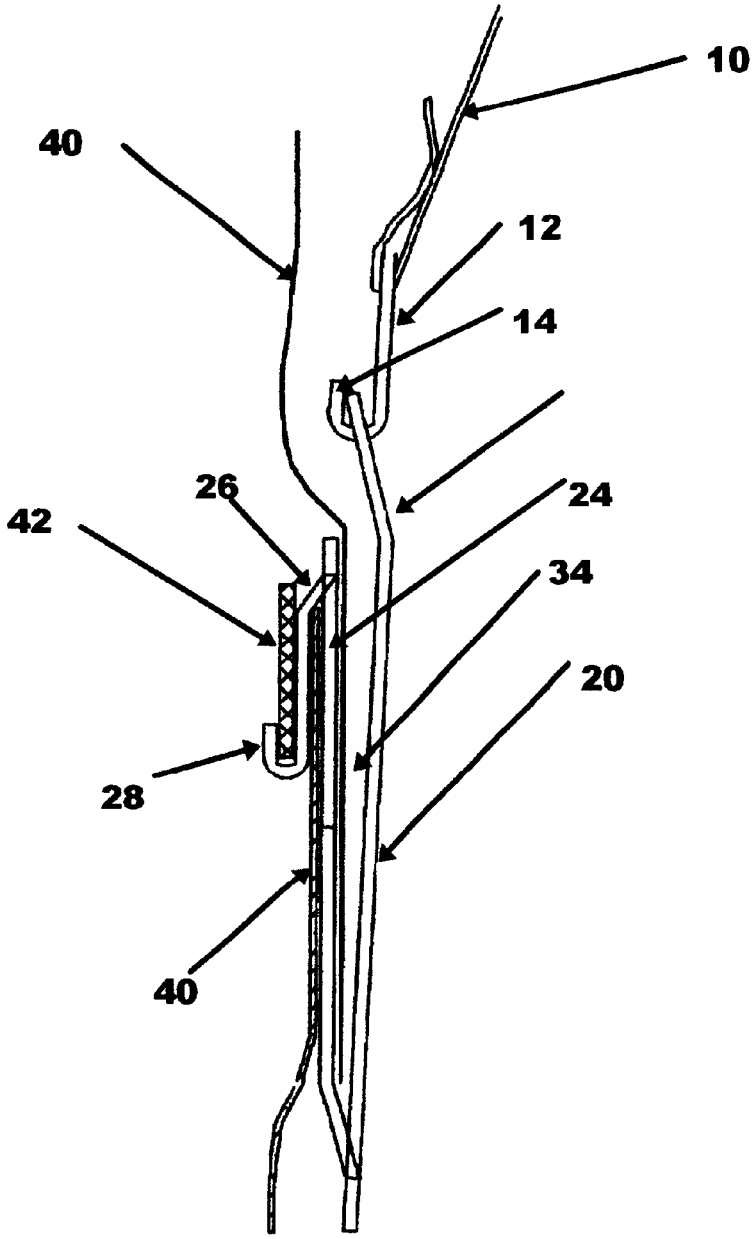
FIG. 3 is a side view of a deployed suspender set.

FIG. 3 shows deployment of the suspender set on one side of an inchoate person to the right on the figure. The elastic strap 10 is show connected to hanger 14 having a broad hook 28 engaged with the ledge 21 on the first part 22 of "W" shaped holder 20. A shirt 40 worn by the person is tucked in to the first space 34 located between the first part 22 of the "W" shaped holder and the second part 24. The third part of the "W" shaped holder 26 passes over the top of trousers 40 worn by the person and under a belt 42 so that the belt is supported by the belt hook 28. When thus worn the suspenders support the belt and are hidden from sight except for the belt hook.

A preferable material for the hangers and "W" shaped holders is a durable plastic such as high-density polyurethane. The parts may be cut out of a flat piece of plastic with a milling machine with the curved surfaces formed by heating the plastic and bending. The parts may also be made in an injection mold, or by other such plastic forming methods well known to those skilled in the art. It is also possible to make the parts from a metal such as aluminum.

The suspender sets may be prepared and distributed assembled, as a set with the hangers attached to the elastic strap or alternatively as a kit comprising an elastic strap and a plurality of hangers and a plurality of "W" shaped holders. Another embodiment is a plurality of "W" shaped holders for use with alternative suspenders. "W" shaped holders can be advantageously used with suspenders not having a hanger with a flat hook, but could also be used with suspenders of the familiar type with jaw type clips which are normally attached directly to a trouser top. In this case the "W" shaped holder would be used just as with a suspender set, except that jaw type clip is clamped onto the top of the first part of the "W" shaped holder, preferably clamping around the ledge. An ordinary pair of suspenders could thus be worn under a persons shirt as with a suspender set.

A suspender set, as previously described, is used to hold up a belt worn by a person on a lower body garment, such as trousers, shorts or a skirt. The suspender set is used to support a belt by the following three steps:

1. placing each of the two "W" shaped holders on two opposite sides of the person such that the first part and second part of each "W" shaped holder are between the lower body garment and the person and the third part passes over the lower body garment and under the belt such that the belt is supported by the belt hook 2. placing the elastic band over a persons shoulders, and
3. placing the broad hook on each of the two hangers through the ledge on one of the two "W" shaped holders, such that the belt is supported by the elastic strap.

If the elastic strap is of the type which is a doubled over elastic strap with its two ends bonded together to form a loop having a top portion and a bottom portion, the method further preferably comprises placing a first arm between the top portion and the bottom portion in a first direction so as to push the top portion behind the person's back, and placing a second arm between the top portion and the bottom portion in a second direction so as to push the bottom portion behind the person's back.

A shirt may then be placed over the suspenders and tucked into each "W" shaped holder in the first space between the first part and the second part of the "W" shaped holder. Thus deployed the suspender set will support the belt and will be largely hidden from view.

Although the present invention has been described in considerable detail with reference to certain preferred versions thereof, other versions are possible. Therefore the spirit and scope of the appended claims should not be limited to the preferred versions herein.

I claim:

1. A suspender set for holding up a belt, comprising:

a. an elastic strap;

b. two hangers, each hanger having a broad hook, each said two hangers connected to said elastic strap;

c. two "W" shaped belt holders, each "W" shaped holder comprising a first part, a second part and a third part; wherein the second part is flexibly attached to the first part and the third part is flexibly attached to the second part; wherein said first part comprises a ledge with size and shape to be engaged by one of the two broad hooks; wherein said third part comprises a belt hook, whereby each of said two "W" shaped belt holders is suitable to be worn by a person under an upper body garment when the elastic strap is worn over the person's shoulders beneath the upper body garment with one of the broad hooks engaged with the ledge, and with the second part between the upper body garment and a pair of trousers, and the third part extending over a waist of the pair of trousers and holding up a belt worn on the pair of trousers.

2. The suspender set of claim 1 wherein the second part is attached to the first part at a first end of the second part and the third part is attached to the second part near a second end of the second part such that the second part can be flexed to create a first space between the first part and the second part and wherein the third part is attached to the second part such that the third part can be flexed to create a second space between the third part and the second part.

3. The suspender set of claim 2 wherein each of the "W" shaped belt holders is milled from a flat piece of durable plastic.

4. The suspender set of claim 3 wherein the durable plastic is high-density polyurethane.

5. The suspender set of claim 1 wherein the elastic strap comprises a closed loop.

6. The suspender set of claim 5 wherein at least one of the two hangers further comprise an adjustable attachment device, whereby an effective length of the elastic strap may be varied.

7. The suspender set of claim 1 wherein the elastic strap comprises rubber.

8. The suspender set of claim 1 wherein the elastic strap comprises a synthetic fiber.

9. The suspender set of claim 1 wherein the upper body garment is a shirt.

10. A "W" shaped holder for use in holding up a belt using an elastic strap in a suspender set, the "W" shaped belt holder comprising:

a. a first part, said first part comprising a ledge thereon, said ledge having a size and shape to be engaged by a broad hook on a suspender;

b. a second part; and c. a third part, said third part comprising a belt hook thereon, wherein said second part is flexibly attached to said first part and said third part is flexibly attached to said second part.

11. The "W" shaped holder of claim 10 wherein the second part is attached to the first part at a first end of the second part and the third part is attached to the second part near a second end of the second part such that the second part can be flexed to create a first space between the first part and the second part and wherein the third part is attached to the second part such that the third part can be flexed to create a second space between the third part and the second part.

12. The "W" shaped holder of claim 11 wherein the "W" shaped belt holder is milled from a single piece of durable plastic.

13. The "W" shaped belt holder of claim 12 wherein the durable plastic is high density polyurethane.

14. The "W" shaped holder of claim 11 wherein the "W" shaped belt holder is injection molded from a durable plastic.

15. A method for holding up a belt worn on lower body garment worn by a person, comprising the acts of:

a. obtaining an elastic strap comprising two hangers attached to the strap, each hanger comprising a broad hook;

b. obtaining two "W" shaped holders, each "W" shaped holder comprising a first part, a second part and a third part; wherein the second part is flexibly attached to the first part and the third part is flexibly attached to the second part; wherein said first part comprises a ledge with size and shape to be engaged by one of the two broad hooks; wherein said third part comprises a belt hook;

c. placing each of the two "W" shaped holders on two opposite sides of the person such that the first part and second part of each "W" shaped holder are between the lower body garment and the person and the third part passes over the lower body garment and under the belt such that the belt is supported by the belt hook;

d. placing the elastic strap over the person's shoulders;

e. placing the broad hook on each of the two hangers through the ledge on one of the two "W" shaped holders, whereby the belt is supported by the elastic strap.

16. The method for holding up a belt of claim 15, wherein the second part is attached to the first part at a first end of the second part and the third part is attached to the second part near a second end of the second part such that the second part can be flexed to create a first space between the first part and the second part and wherein the third part is attached to the second part such that the third part can be flexed to create a second space between the third part and the second part.

17. The method of claim 16, wherein the elastic strap is doubled over elastic strap with the ends thereof bonded together, the elastic strap having a top portion and a bottom portion, and wherein the method further comprises the acts of placing a first arm between the top portion and the bottom portion in a first direction so as to push the top portion behind the person's back, and placing a second arm between the top portion and the bottom portion in a second direction so as to push the bottom portion behind the person's back.

18. The method of claim 17 further comprising the act of placing an upper body garment over the elastic strap and under the lower body clothing such that the upper body garment passes in the first space, whereby the suspender set supports the belt while being substantially hidden under the upper body garment and the lower body clothing.

19. The method of claim 16 further comprising the act of placing an upper body garment over the elastic strap and under the lower body clothing such that the upper body garment passes in the first space, whereby the suspender set supports the belt while being substantially hidden under the upper body garment and the lower body clothing.

20. The method of claim 16 wherein the lower body garment is a pair of trousers and the upper body garment is a shirt.

21. The method of claim 16 wherein the elastic strap comprises rubber.

22. The method of claim 16 wherein the elastic strap comprises a synthetic fiber.

* * * * *